United States Patent [19]

Hank et al.

[11] 4,049,213

[45] Sept. 20, 1977

[54] AUTOMATIC REGULATION OF THE POSITION OF THE LATERAL EDGE OF A TRAVELLING WEB

[75] Inventors: Dietrich Hank; Gerhard Lipfert; Tassilo Niesgoda, all of Leipzig, Germany

[73] Assignee: VEB Polygraph Leipzig Kombinat fur Polygraphische Maschinen und Ausrustungen, Leipzig, Germany

[21] Appl. No.: 680,875

[22] Filed: Apr. 27, 1976

[30] Foreign Application Priority Data

May 12, 1975 Germany ..... 185938

[51] Int. Cl.[2] ..... B65H 25/26

[52] U.S. Cl. ..... 242/57.1; 226/19; 226/20

[58] Field of Search ..... 242/57.1; 226/15, 16, 226/17, 18, 19, 20, 21, 22, 27, 29

[56] References Cited

U.S. PATENT DOCUMENTS

| | | | |
|---|---|---|---|
| 2,641,416 | 6/1953 | McCleary | 242/57.1 |
| 3,232,547 | 2/1966 | Thiede | 226/20 |
| 3,568,904 | 3/1971 | Kurz | 226/15 |
| 3,786,974 | 1/1974 | Kron | 226/19 |

*Primary Examiner*—Edward J. McCarthy
*Attorney, Agent, or Firm*—Michael J. Striker

[57] ABSTRACT

A web travels along a predetermined path. A regulating system automatically keeps the position of the preselected first tolerance range. The system includes sensing, position-correcting and regulator units. The sensing unit senses the position of the lateral edge of the travelling web. The position-correcting unit effects corrective movements of the travelling web in a manner causing the lateral edge thereof to change positions. The regulator unit is connected to the sensing and position-correcting units and causes the latter to effect corrective movements of the travelling web at a first speed when the sensed position of the web edge is outside the first tolerance range and at a different second speed when the sensed position of the web edge is outside a preselected different second tolerance range.

17 Claims, 8 Drawing Figures

AUTOMATIC REGULATION OF THE POSITION OF THE LATERAL EDGE OF A TRAVELLING WEB

BACKGROUND OF THE INVENTION

The invention relates to regulating systems (automatic control systems incorporating negative-feedback regulation) operative for regulating the position of the lateral edge of a travelling web of constant web width.

In general such a lateral-edge regulating system (automatic control system incorporating negative-feedback regulation) is comprised of one or more sensing devices operative for sensing the position of at least one of the lateral edges of the travelling web. The edge-position-indicating signal generated by the sensing device is applied to the regulator of the system. The regulator determines whether the edge position is within an acceptable range of positions and, if not, in what direction the edge must be shifted to restore the edge to such range. The regulator then furnishes at its output a corrective positioning signal. This corrective positioning signal is applied to a positioning device, which in turn causes the edge to be shifted back into the range of acceptable positions. The positioning device may be comprised, for example, of an hydraulically activated servo positioner operative for effecting axial shifting of the supply roller off of which the web is being pulled. Alternatively, the positioning device can effect a compensatory swinging movement of one or more web transport rollers in such a direction as to cause the sensed edge of the travelling web to move back into the acceptable range of positions.

When negative-feedback regulation is employed for the specific purpose of regulating the position of the lateral edge of a travelling web (such as an elongated web of paper being fed to a rotary printing machine), a problem which we have found to arise involves system-response dead times resulting for the most part unavoidably from certain relative positions which must be, or as a matter of practice are, maintained between the edge-positon-sensing means of the regulating system, on the one hand, and the position correcting means of the system, on the other hand.

In general, the distance between the edge-position-sensing means of the system and the position-correcting means of the system results from the following. In order to avoid the development of undetected edge position deviations intermediate the edge-position sensing means and the web-consuming machine (such as a rotary printing machine), it is customary to locate the edge-position sensing means as little upstream of the consumer machine as possible. Unfortunately, however, in virtually all practical constructions, there is so close to the web-consuming machine not enough room in which to place the position-correcting means of the regulating system. As a result, the position-correcting means is typically located a considerable distance upstream of the edge-position-sensing means of the system.

This considerable distance between the edge-position-sensing means and the position-correcting means of the regulating system tends to result in the following characteristic behaviour of the edge-position-regulating system:

So long as the web edge remains within the preselected range of acceptable positions (the tolerance range), no position-correcting signal is generated. If the web edge shifts in either direction out of the tolerance range, then a position-correcting signal is generated and persists until such time as the edge-position-sensing means detects a return of the web to within the tolerance range. This position-correcting signal is applied to the position-correcting means of the regulating system, causing the web edge to more or less gradually or suddenly be shifted back into the tolerance range. Because the position-correcting means is located a considerable distance upstream of the edge-position-sensing means, it follows that a certain time, the so-called dead time, elapses before a completed position correction performed at the position-correcting means is actually sensed by the edge-position-sensing means.

As a result of this dead time, the position-correcting means will overregulate. Even after is has shifted the web edge back into the tolerance range, it will continue to shift the web edge in such direction until the dead time elapses and the edge-position-sensing means actually detects the restoration of the edge to the tolerance range. This overregulation manifests itself in repeated overshoots of alternate ones of the two limits of the tolerance range. Each overshoot gives rise to a new corrective action in the opposite direction, so that in the steady state of the regulating system the web edge will shift back and forth out of the tolerance range, continually, unless one resorts to measures described below.

If the overregulation is not counteracted it can become extraordinarily large, particularly when edge position deviations occur quickly in a particular system and/or have large magnitudes when they do occur. Essentially, the principal way of reducing the overregulation is to reduce the speed with which the corrective action is performed in response to the detection of an unacceptable edge-position deviation. However, reduction in the speed of the corrective action leads to a greater amount of waste. For example, if the travelling web is an elongated web of paper being fed into a rotary printing machine, a deliberate reduction of the speed with which the corrective action occurs will necessarily result in the improper (e.g., unacceptably centered) printing of an increased number of sheets cut from the travelling web.

For the foregoing reasons, it becomes impossible, as a purely practical matter, to successfully enough make use of three-point regulators. Three-point regulators are bidirectional regulators which have only three states: positive ON, negative ON, and OFF. Moreover, they exhibit a dead band intermediate the positive ON and negative ON states, so that the regulated variable can vary within a certain tolerance range without triggering a regulating (corrective) action. Specifically, three-point regulators cannot be used successfully enough in the context described above when it is desired to have a regulating system which exhibits both a narrow tolerance range and high speed of corrective action. When both these latter two demands are made of the system, resort must be had to regulating systems operating on a totally analog basis or at least incorporating analog components. Analog regulators are more efficient in this regard than three-point regulators because as the magnitude of the sensed edge-position deviation decreases during the course of a corrective action, the speed of the corrective action likewise decreases, thereby reducing the tendency of the system to go into overregulation. However, analog regulating systems, or regulating systems making extensive use of analog components, are considerably more expensive and more susceptible to malfunction than are for example ON-off regulating system components.

The dead times resulting from web travel from the position-correcting means to the edge-position-sensing means can be reduced to a certain extent by correspondingly decreasing the distance between the two means in question. However, the dead times, usually as a matter of principle, cannot be eliminated altogether because, as a result of the corrective shifting of the web edge back into the tolerance range, edge folds often form in the travelling web. Accordingly, a correct measurement of the position of the web edge can only be performed at a location which is far enough upstream to ensure the disappearance of any edge fold which may have formed. Somewhat similarly, if the position of the web edge is corrected by means of transport rollers which are swingable to "steer" the web to the left or right, the corrective swinging movement of the transport rollers will have an effect upon the sensed position of the web edge only after the elapse of a certain web travel time; accordingly, here likewise, as a matter of principle, the position-correcting means and the edge-position-sensing means must be arranged a certain distance from each other, with the result that the dead time cannot be decreased below a certain minimum.

When in this way the minimum dead time is predetermined by the physical and spatial characteristics of the system is question, design of the system such that position corrections are performed at high speed, in order to compensate quickly for position deviations, and/or in order to handle large-magnitude deviations, so as to reduce the number of, for example, improperly printed sheets cut from the web, tends to result in unstable regulation, just as when a very narrow tolerance range in selected.

If the regulating system is to be very accurate and stable, then the system necessarily must be slow in responding to sensed edge position deviations, with the consequence that a large number of sheets to be cut from the web will be improperly printed, for example. Alternatively, one can utilize high-speed corrective action, but then one must live with an unstable overreactive regulating system which, again, will perit a large number of sheets to be improperly printed.

In practice, one usually makes a compromise, by selecting a high speed for the performance of the position-correcting action, but simultaneously therewith selecting the widest tolerance range acceptable. What results is a system which is not always sufficiently accurate in its action, which furthermore permits a considerable waste of web, and which finally requires relatively expensive analog control components to keep the system as stable as possible. As already mentioned, with an analog regulating system for the positioning of the lateral edge of the travelling web, the signal generated by the sensing means of the system is directly proportional to the position of the web, or sometimes is directly proportional to the magnitude of the position deviation. As a result, the speed with which the corrective action is performed is not a constant throughout the corrective action, but instead decreases as the magnitude of the edge-position deviation decreases. Moreover, even these analog regulating systems often go into overregulation, necessitating the use of additional speed-reducing components for reducing the speed of the corrective action even below that which occurs automatically by virtue of the nature of analog regulation.

SUMMARY OF THE INVENTION

It is a general object of the invention to provide a regulating system specifically intended for the regulation of the position of the lateral edge of a travelling web, so designed as to exhibit accuracy higher and web waste lower than could be achieved in the prior art.

An additional object of the invention is to provide a regulating system of the type in question so designed as to make possible the use of non-continuously operating components even in situations where hitherto the performance demands made upon a comparable system absolutely necessitated the use of the continuously operating (analog) system components. In this way, the improvement in the performance of the edge-position-regulating system can be brought about without any increase in the cost of the system.

More particularly, it is an object to so design the edge-position-regulating system that it can operate within very narrow tolerance ranges of the type hitherto achievable only with analog system components, but instead using non-analog (ON-OFF) components, and all this despite the aforediscussed unavoidable dead times which regulating systems of the type in question must exhibit.

These objects, and others which will become more understandable from the description, below, of preferred embodiments, can be met by establishing at least two tolerance ranges, a narrow tolerance range within a wider tolerance range. When the edge position leaves the narrow tolerance range but still remains within the wider tolerance range, a corrective action is performed at a relatively low speed. When the edge position leaves the wider tolerance range, a corrective action is performed at relatively high speed. In the latter case, when the corrective action has returned the edge, as sensed, to within the confines of the wider range, the remainder of the corrective action is performed at the relatively low speed associated with the leaving of the narrow tolerance range.

The two (or more) tolerance ranges and the different associated speeds for the performance of the corrective action can be established in several ways specifically contemplated by us.

Use can for example be made of two discrete edge-position-sensing means, one operative for generating error signals when the web edge moves in either direction out of the narrow tolerance range, the other operative for generating error signals when the web edge moves in either direction out of the wide tolerance range. Each of these two discrete sensing means can be associated with a respective one of two discrete regulators and furthermore with a respective one of two discrete position-correcting means controlled by the respective regulators. Alternatively, these two discrete sensing means can be associated with a single regulator. If a single regulator is employed, then it can supply activating signals to a single position-correcting device, with the activating signals differing in dependence upon the tolerance range which has been exceeded, so that the corrective action will be performed with the speed associated with the tolerance range in question. Alternatively, the single regulator can control the operation of two discrete position-correcting means, one operative at a low speed and the other at a high speed.

As a further possibility, use can be made of a single sensing means, instead of two discrete sensing means. In that event, the two (or more) discrete tolerance ranges can be established by using evaluating devices to evaluate the signal generated by the sensing means and determine whether the web edge is within both tolerance ranges, within only the wider range, or within neither of the ranges. For example, a photoelectric detector can be used to generate an edge-position-indicating signal. This signal can be applied to four Schmitt triggers; the output signals from these four Schmitt triggers would provide the information in question, and could be utilized to properly activate the position-correcting means, at the speed proper for the tolerance range which has been left, and in the direction necessary to effect corrective action.

Thus, the two (or more) discrete sensing means can be combined into one, and/or the two (or more) discrete regulators can be combined into one, and/or the two (or more) discrete position-correcting means can be combined into a single positioning means capable of performing a corrective action at different speeds. Because of this, it may at first seem that the invention would comprehend a simple single-loop regulating circuit for the control of the position of the lateral edge of the travelling web. Therefore, to differentiate the invention from a comparable, completely analog regulating system, it is necessary to expressly state that regulating systems consisting of a single-loop, purely analog regulating circuit are not comprehended within the scope of the invention, because they do not have more than one discrete tolerance range in the sense of the various regulating systems of the invention.

One way of viewing the regulating systems of the invention is to say that they represent the combination of a main regulating (servo) loop with an auxiliary regulating (servo) loop. The one regulating circuit (course regulating circuit) reacts to deviations outside the wider tolerance range by effecting the performance of a corrective action at high speed. The other regulating circuit (fine regulating circuit) reacts to deviations outside the narrow tolerance range but still within the limits of the wider tolerance range by effecting the performance of a corrective action at low speed.

If desired, both regulating loops can be composed of non-continuously operating (non-analog) system components, for example three-point regulators and the like. Compared to totally continuous regulating systems of the type in question, wherein analog signals are generated, amplified accurately and then applied in amplified form to continuously adjustable position-correcting means, the inventive regulating system has the advantage of making possible the use system components which involve the generation and processing of only three different signals (−1, 0, +1). Digital switching circuits, digital amplifiers and digital position-correcting means are all much simpler, cheaper and less susceptible to malfunction than their analog counterparts.

With the width of the plurality of tolerance ranges, and the speeds for the corrective actions to be associated with them, appropriately selected, it becomes possible to regulate out suddenly developed large-magnitude edge-position deviations in an optimally short time in a manner involving no overshooting. Specifically, the corrective action is performed by the high-speed position-correcting means only until such time as the sensed position deviation shifts into the confines of the narrow tolerance range. Accordingly, only low-magnitude position deviations need be corrected by the fine regulating circuit. If it is desired to further improve stability and accuracy, then use can be made of analog system components for just the fine regulating circuit. In that event, the speed with which the correction of the residual position deviation is performed will decrease in proportion to the decrease in the deviation. As a result of the increased accuracy and decreased positioning speed, there is also achieved a decreased mechanical stressing of the web during the performance of the corrective action and a reduced tendency of the position-correcting means to form edge folds. The reduced formation of edge folds, in turn, results in a decrease of the minimum necessary spacing between the position-correcting means and the position-sensing means, and accordingly results in a decrease of the dead time itself.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
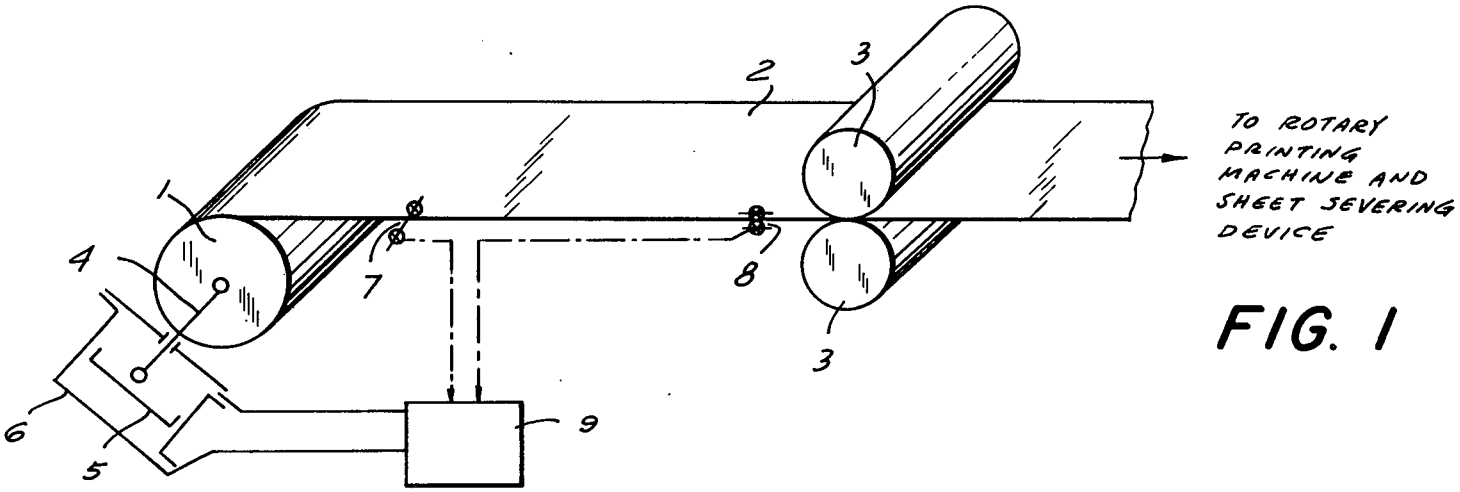
FIG. 1 depicts in schematic perspective form a first embodiment of a web transport apparatus and components of the regulating system which regulates the position of the lateral edge of the travelling web.

FIG. 1 depicts a travelling paper web 2 being pulled off a supply roller 1 and transported along a predetermined path by means of transport rollers 3 toward a rotary printing press and sheet-severing machine, or other sheet consuming apparatus.

Supply roller 1 is mounted on a rotation shaft 4 which in turn is coupled to a piston 5 shiftably mounted inside the cylinder 6 of a very schematically depicted, hydraulically activated position-correcting device. When piston 5 is shifted, in response to the application of pressure to the left or right control ports of the device 5, 6, rotation shaft 4 and supply roller 1 itself undergo a corresponding shift towards either the left or right. In this way, deviations of the position of the lateral edge of the travelling web 2 from a preselected range of acceptable positions (the tolerance range) can be corrected.

Located intermediate the supply roller 1 and the transport rollers 3 is one edge-position-sensing unit 7 and, downstream of the latter, another edge-position-sensing unit 8. Many different devices can be used for the edge-position-sensing units 7 and 8. In the illustrated embodiments, use is made of photoelectric detectors. In FIG. 1, the transverse spacing between the two photoelectric detectors of unit 7 is considerably greater than the transverse spacing between the two photoelectric detectors of unit 8. In FIG. 1, these two spacings serve to establish the narrower and wider tolerance ranges, the narrower tolerance range being within the wider tolerance range.

For either the unit 7 or the unit 8, if the edge of the travelling web is within the associated tolerance range, the inner photoelectric detector will be blocked by the edge portion of the web whereas the outer photoelectric detector will be unblocked. If the edge of the travelling web moves inward (in direction towards the longitudinal centerline of the travelling web) to a position outside the associated tolerance range, then both photoelectric detectors of the unit 7 or 8 associated with that tolerance range will become unblocked. Likewise, if the edge of the travelling web moves outward (in directon away from the longitudinal centerline of the travelling web) to a position outside the associated tolerance range, then both photoelectric detectors of the unit 7 or 8 associated with that tolerance range will become blocked.

Thus, four signals are generated, one by each of the four photoelectric detectors employed for the two sensing units 7 and 8 of FIG. 1. Each signal will have either the value 0 or the value 1, depending upon whether the associated photoelectric detector is blocked or unblocked. The values of the four signals, considered in conjunction, provide information as to whether the web edge is within the narrowest tolerance range, outside the narrower tolerance range but still within the wider tolerance range, or outside even the wider tolerance range. These four signals are applied to a regulator 9 operative for controlling the hydraulically activated position-correcting means 5, 6.

Figure 2E:
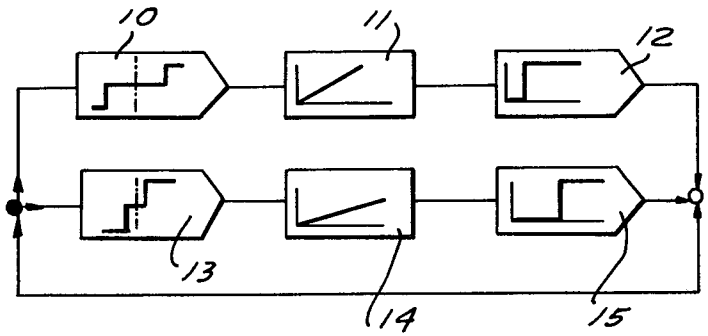
FIG. 2*a* to 2*e* depict details of regulating systems which can be employed with either the set-up of FIG. 1 or that of FIG. 3.
Figure 2A:
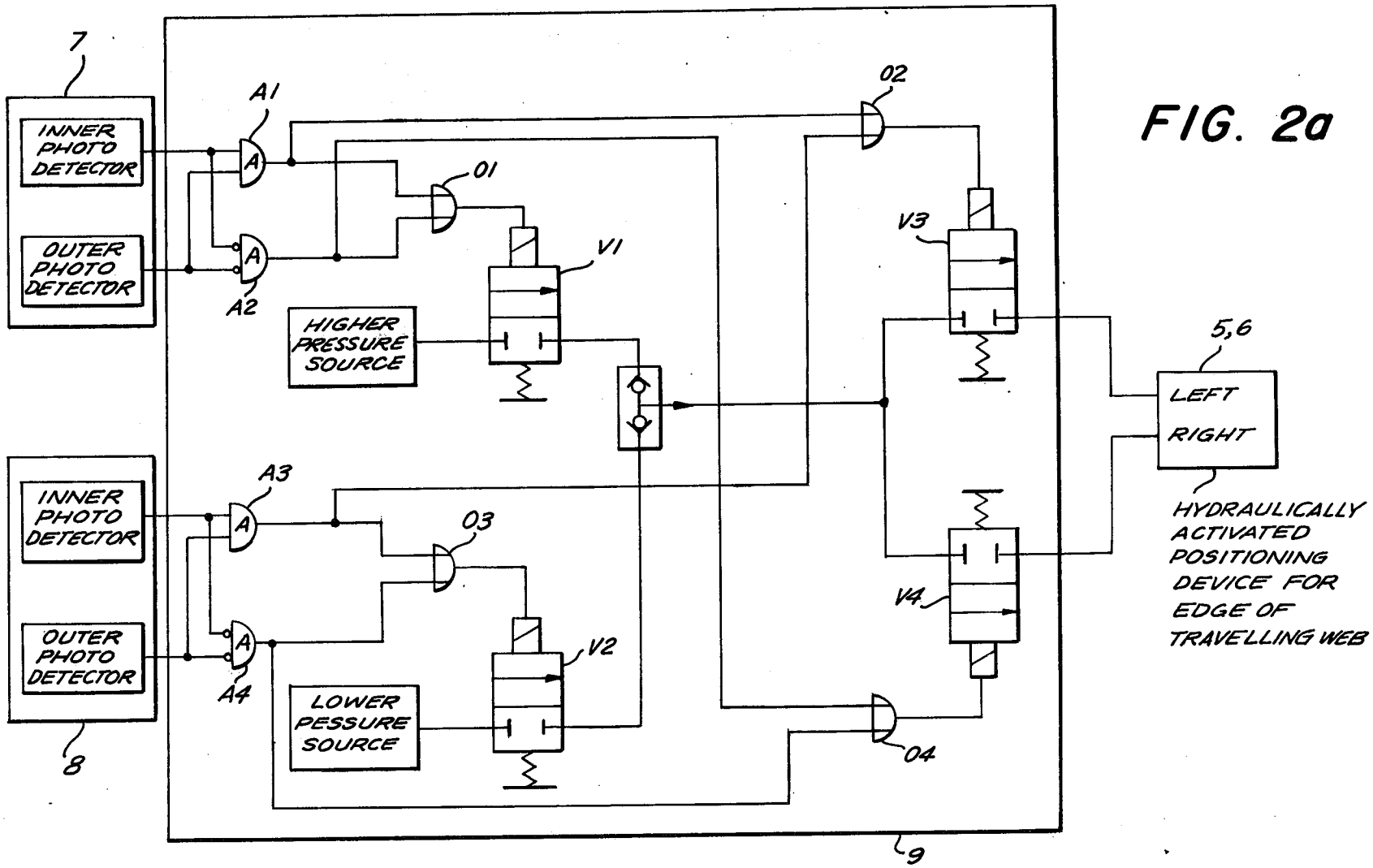

FIG. 2*a* depicts in greater detail one version of the set-up of FIG. 1. The inner and outer photoelectric detectors of sensing units 7 and 8 are shown. The hydraulically activated position-correcting device 5, 6 is depicted as having left and right control inputs, for effecting corrective shifting of the supply roller 1 in either the leftward or rightward direction.

In FIG. 2a, the regulator 9 is provided at its inputs with four AND-gates A1, A2, A3, A4. AND-gates A2 and A4 are provided at both their inputs with NOT-gates (inverters), shown in conventional manner as empty input circles.

The upper pair of AND-gates A1, A2 receives the two signals generated by the two photoelectric detectors of the edge-position-sensing unit 7, associated with the wider tolerance range. AND-gates A1, A2 are provided to detect the existence of two situations: one, the situation in which both the inner and the outer photoelectric detector are unblocked; and two, the situation in which both the inner and the outer photoelectric detector of unit 7 are blocked. The first situation corresponds to movement of the web edge outside the wider tolerance range to one side; the other situation corresponds to movement of the web edge outside the wider tolerance range, but to the other side of the range. Depending upon the direction in which the web edge leaves the wider tolerance range, a 1 signal will appear at the output of either AND-gate A1 or else AND-gate A2.

The two lower AND-gates A3, A4 operate in exactly the same way, but are associated with the narrower tolerance range. Depending upon the direction in which the web edge leaves the narrower tolerance range, a 1 signal will appear at the output of either AND-gate A3 or else AND-gate A4.

The appearance of a 1 signal at the output of either one of the two AND-gates A1, A2 indicates that the edge has left the wider tolerance range. Accordingly, the two outputs of AND-gates A1, A2 are connected to the inputs of OR-gate 01, the output of which is connected to and activates the control solenoid of a two position valve V1. Thus, if the web edge moves outside the wider tolerance range, valve V1 becomes activated, connecting a source of higher hydraulic pressure to the inputs of regulator valves V3, V4, whose operation is described below. It is sufficient to note now that this activation of the regulator valve V1, associated with the higher pressure source, readies the regulator to connect the higher pressure source, not the lower pressure source, to either the left or right control input of position-correcting means 5, 6. Accordingly, the corrective action which is to ensue will be performed at the high speed associated with departure from the wider tolerance range, not the low speed associated with edge positions outside the narrower tolerance range but still within the wider tolerance range.

Similarly, if the edge position is outside the narrower tolerance range, but still within the wider tolerance range, then a 1 signal will appear at the output of one or the other of the AND-gates A3, A4, depending upon the sense (left or right) of the deviation. This deviation calls for a lower-speed corrective action. Accordingly, the outputs of AND-gates A3, A4 are connected to the inputs of an OR-gate 03, the output of which is connected to the control solenoid of a pressure control valve V2. When valve V2 becomes activated, the lower pressure source is connected to the inputs of the left and right regulator valves V3, V4, so that only the lower pressure will be available for performance of the position-correcting operation, which will accordingly occur at the lower speed associated with the narrower tolerance range—or more precisely, associated with edge positions which are outside the narrower tolerance range but still within the wider tolerance range.

In FIG. 2a, the outputs of the valves V1, V2 are connected to the inputs of left and right regulator valves V3, V4 through the intermediary of a crossover valve operative for permitting only the higher of the two pressures at the outputs of valves V1, V2 to be applied to the inputs of valves V3, V4. Thus, when the edge position falls outside the wider tolerance range, resulting in activation of valve V1, the crossover valve will prevent the pressure from the lower pressure source from becoming applied to regulator valves V3, V4, despite the fact that valve V2 like valve V1 will be in its activated condition. The crossover valve is optional, and is used only when it is desired, for whatever reason, not to superimpose the pressure from the lower pressure source upon that from the higher pressure source.

Thus, depending upon whether the web edge position is outside the narrower tolerance range only, or additionally outside the wider tolerance range, the pressure from either the higher pressure source (via valve V1) or the lower pressure source (via valve V2) will be applied to the inputs of left and right regulator valves V3, V4.

The activation of the left and right regulator valves V3 and V4 occurs in dependence upon the sense (left or right) of the deviation, and not in dependence upon whether the deviation is outside one or both of the two tolerance ranges. The outputs of AND-gates A1, A3 are both connected to the two inputs of OR-gate 02, the output of which is connected to the control solenoid for the left regulator valve V3. The outputs of AND-gates A2, A4 are both connected to the two inputs of OR-gate 04, the output of which is connected to the control solenoid for the right regulator valve V4.

Thus, if a 1 signal appears at the output of either AND-gate A1 or A3, left regulator valve V3 will become activated and connect the already selected pressure source to the left control input of position-correcting means 5, 6. On the other hand, if a 1 signal appears at the output of either AND-gate A2 or A4, right regulator valve V4 will become activated and connect the already selected pressure source to the right control input of position-correcting means 5, 6.

Thus, the left or right control input of position-correcting means 5, 6 will be activated by pressure fluid from either the higher pressure source or the lower pressure source, depending upon which of the two regulating valves V3, V4 is activated, and depending upon which of the two pressure control valves V1, V2 is activated.

In FIG. 2*a*, the system is comprised of two discrete edge-position-sensing means 7 and 8 feeding information to a single regulator 9 which in turn controls the operation of a single hydraulically activated position-correcting means 5, 6.

It is possible to replace the single regulator 9 with two discrete regulators each associated with one of the two tolerance ranges and/or to replace the single position-correcting means 5, 6 with two discrete position-correcting means. These possibilities are shown, in conjunction, in FIG. 2*b*.

Figure 2B:
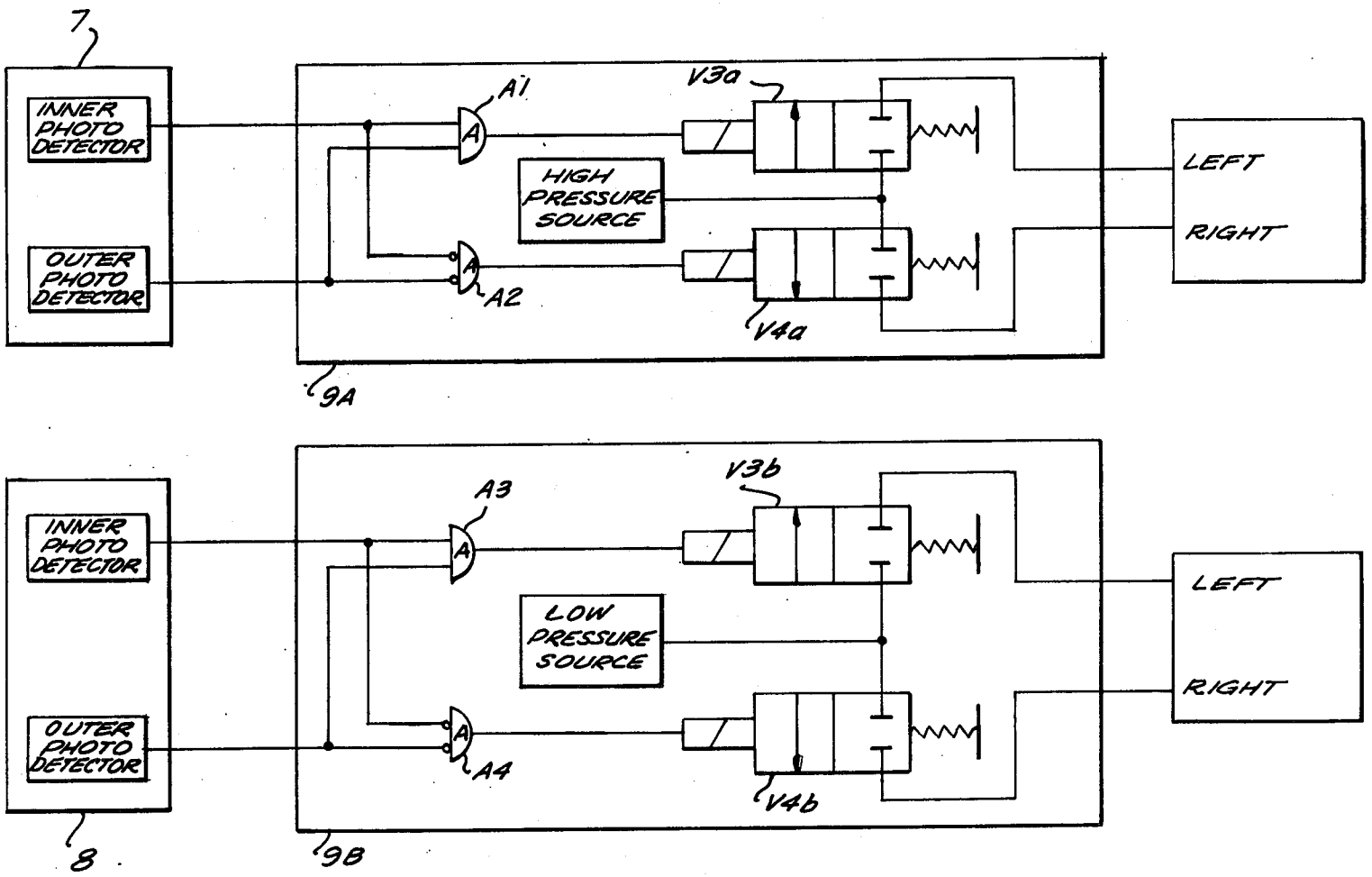

In FIG. 2*b*, components corresponding in their operation to those of FIG. 2*a* are correspondingly numbered. Valves V3 and V4 of FIG. 2*a* are replaced in FIG. 2*b* by a first pair of valves V3*a*, V4*a* and a second pair of valves V3*b*, V4*b*. The operation of the embodiment of FIG. 2*b* will be self-evident from the foregoing explanation of that of FIG. 2*a*.

Figure 2C:
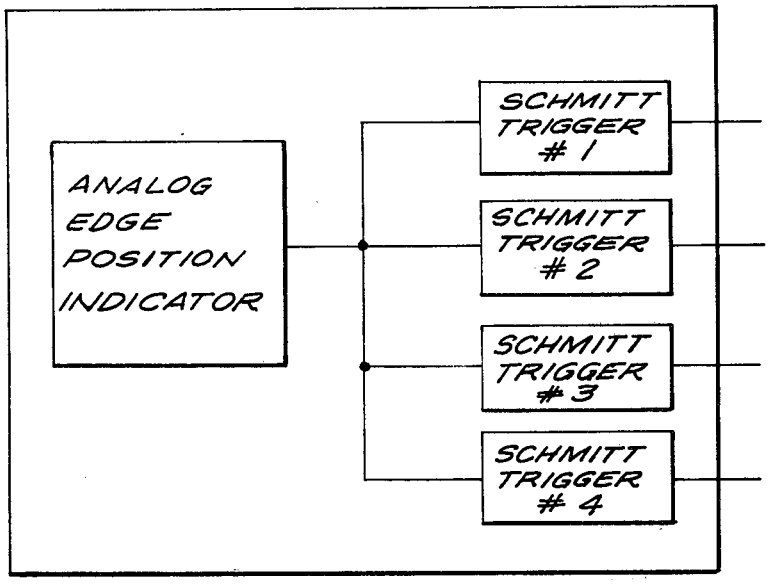

In both FIGS. 2*a* and 2*b*, two discrete sensing means 7 and 8 are employed for feeding edge-position information to the single regulator 9 or to the two discrete regulators 9*a*, 9*b*. The two discrete sensing means 7 and 8 can be combined into a single sensing means in a variety of ways, one of which is shown in FIG. 2*c*. In FIG. 2*c* the digital photoelectric detectors are replaced by an analog edge position indicator of any suitable type, for example again operating on a photoelectric basis. This unit generates an analog signal whose magnitude is for example directly proportional to the absolute edge position, measured with respect to a reference or zero position, or else directly proportional to edge-position deviation. In either case, this analog signal is applied to four Schmitt triggers. The four outputs of the Schmitt triggers will correspond in every respect to the four outputs of the two sensing means 7 and 8 already described. The single sensing unit of FIG. 2*c* can be used in conjunction with either the single-regulator set-up of FIG. 2*a* or the multiple-regulator set-up of FIG. 2*b*. Moreover, in either of the latter two cases, two discrete position-correcting means or else the single position-correcting means of FIG. 2*a* can be used.

The advantage of using two position-correcting means as in FIG. 2*b* is that each can be differently designed to be particularly effective at the associated corrective-action speed. This is shown for example in FIG. 3, discussed below, wherein one position-correcting means 5, 6 operates by axially shifting the supply roller, whereas the other position-correcting means operates by swinging a pair of transport rollers, each position-correcting means accordingly effecting position corrections in a different way respectively appropriate for high-speed or low-speed corrective action.

Figure 2D:
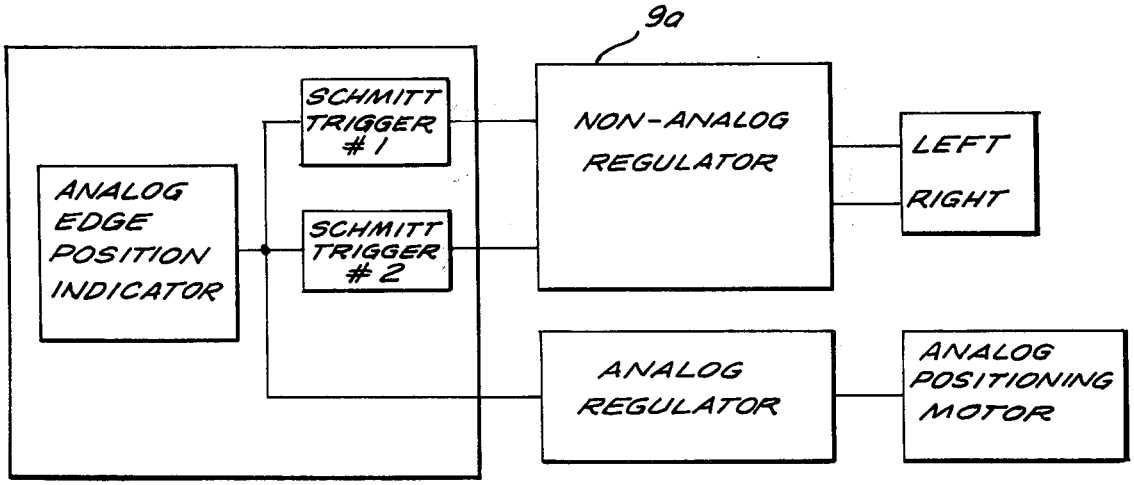

A further possibility is illustrated in FIG. 2*d*. It may be desired to use non-analog system components for the coarse regulating loop associated with the wider tolerance range, and to use at least some analog system components for the fine regulating loop associated with the narrower tolerance range. It might for example be desired to employ a non-analog regulator to control a non-analog position-correcting means for responding to deviations outside the wider tolerance range, and to employ an analog regulator and an analog position-correcting means for responding to deviations outside the narrower but not the wider tolerance range. In that event, a modification of the arrangement shown in FIG. 2*c* is employed. Schmitt triggers No. 1 and No. 2 are retained, with their two outputs feeding information to the non-analog regulator. However, Schmitt triggers No. 3 and No. 4 are omitted; in their place, the analog signal furnished by the analog edge position indicator is applied directly to the input of the analog regulator which, in turn, controls the operation of an analog positioning device, for example an ordinary electrical servo motor.

It will be understood that the depiction of an hydraulic cylinder-and-piston type of position-correcting means is merely exemplary. Use could be made of conventional electric servo motors, digitally controlled stepper motors operative for turning through a number of angular steps equal to the number of input pulses applied thereto, and so forth.

FIG. 2*e* depicts in schematic manner some characteristics of the behaviour of the regulating systems discussed in connection with FIG. 1. Numeral 10 denotes the three-point measurement operation of the sensing unit 7 associated with the wider tolerance range; numeral 13 denotes the three-point measurement operation of the sensing unit 8 associated with the narrower tolerance range. Numeral 11 denotes the higher speed at which the position-correcting action occurs under the control of the coarse regulating loop, in response to deviations outside the wider tolerance range. Numeral 14 denotes the lower speed at which the position-correcting action occurs under the control of the fine regulating loop, in response to deviations outside the narrower tolerance range but still within the wider tolerance range. Numeral 12 denotes the lesser dead time inherent in the coarse regulating loop, attributable to the lesser distance between sensing unit 7 and position-correcting means 5, 6. Numeral 15 denotes the greater dead time inherent in the fine regulating loop, attributable to the greater distance between sensing unit 8 and position-correcting means 5, 6.

Figure 3:
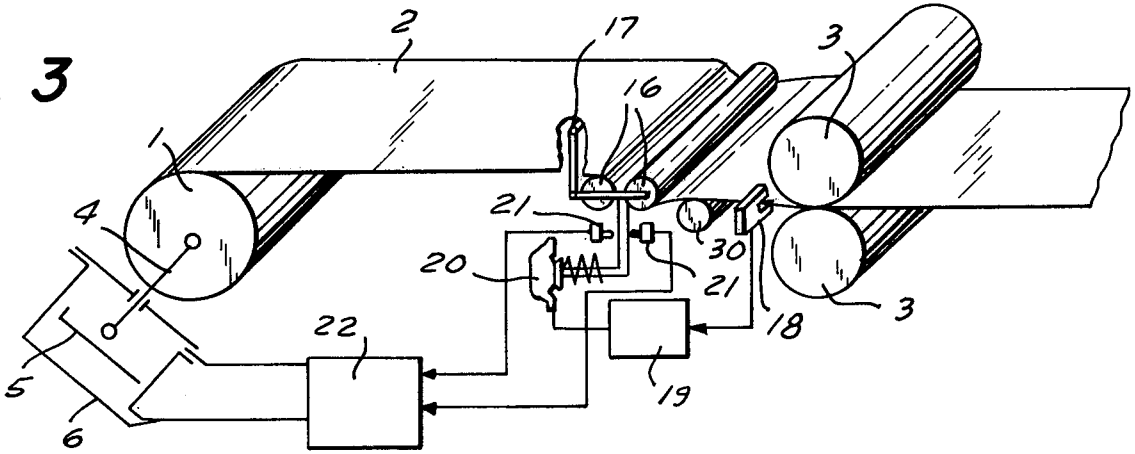
FIG. 3 depicts another embodiment of a web transport apparatus and components of a somewhat modified regulating system.

FIG. 3 depicts another set-up according to the invention. Components corresponding to those of the set-up of FIG. 1 are denoted by the same reference numerals. The regulating system is comprised, as before, of two regulating loops, but in FIG. 3 the coarse regulating loop is non-analog whereas the fine regulating loop is analog.

In FIG. 3, the fine regulating loop incorporates an analog edge position indicator 18 which applies an analog signal to an analog regulator 19. Analog regulator 19 in turn controls the operation of an analog position-correcting means. The analog position-correcting means illustrated includes a pneumatic diaphragm motor 20 which is operative against the force of a resisting biasing spring for effecting swinging of a pair of guide rollers 16 mounted for swinging movement about a pivot axis 17. Such swinging of the guide rollers 16 effects a corrective shifting of the web edge. Located downstream of the swingably mounted guide rollers 16 is a steadying roller 30. Roller 30 presses only lightly against the travelling web 2, so as not to impress any folds. However, roller 30 does steady the web enough to permit the location of the analog edge position indicator 18 just downstream of the steadying roller.

In the set-up of FIG. 3, the coarse regulating loop of the regulating system does not include a sensing unit for directly sensing the edge of the travelling web. Instead, use is made of opposing limit switches 21 operative for detecting when a portion of the moving structure of analog position-correcting means 20 has reached predetermined limits of its range of movement. The signals generated by the limit switches 21 are applied to a non-analog regulator 22 which in turn controls the operation of the hydraulically activated position-correcting means 5, 6. As before, the coarse regulating loop comes into operation when the web edge position falls outside the wider tolerance range. In FIG. 3, however, this is detected only indirectly; the limit switches 21 respond in particular to the attempt of the analog regulating loop to correct edge position deviations so large as to clearly fall outside the wider tolerance range. It will be understood that details of the regulating loops, particularly the regulator of the coarse regulating loop, correspond to what has been explained with respect to the set-up of FIG. 1.

Figure 4:
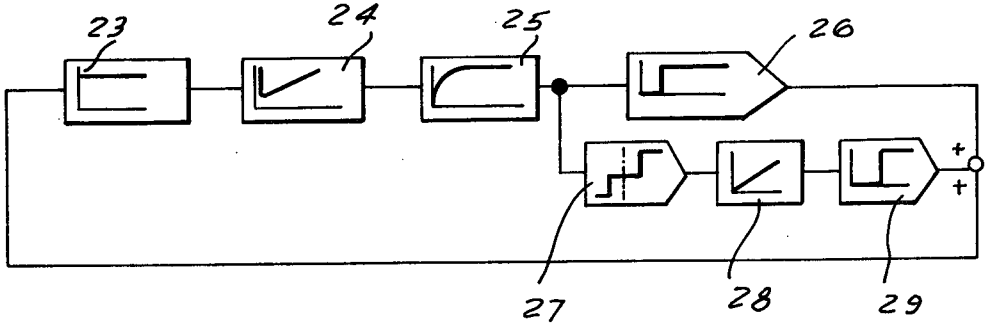
FIG. 4 illustrates the regulating system used with the set-up of FIG. 3.

FIG. 4 depicts schematically certain aspects of the behavior of the regulating system employed with FIG. 3. Numeral 18 denotes the proportional analog character of the edge-position-indicating signal generated by sensing unit 18. Numeral 24 denotes the characteristics of the analog regulator 19, which here exhibits proportional-plus-integral-differential behavior. Numeral 25 denotes the behavior of the analog position-correcting means comprised of the pneumatic diaphragm motor 20 and swingable guide rollers 16. As indicated in box 25, there is a levelling out of the response of the analog position-correcting means to sensed deviations in excess of a certain magnitude; deviations in excess of a certain magnitude are to be dealt with by the coarse regulating loop of the system, not the fine regulating loop. Numeral 26 denotes the dead time inherent in the behavior of the coarse regulating loop, attributable to the distance between sensing unit 18 and position-correcting means 20, 16. Numeral 27 denotes the three-point response characteristic of the sensing unit of the coarse regulating loop of the system, the sensing unit of the coarse regulating loop being essentially comprised of the two limit switches 21. Numeral 28 denotes the relatively high speed at which the position-correcting means 5, 6 of the coarse regulating loop performs position corrections. Numeral 29 denotes the dead time inherent in the behavior of the coarse regulating loop of the regulating system for FIG. 3. It will be noted that the dead time 26 in the response of the fine regulating loop is less than the dead time 29 in the response of the coarse regulating loop. This is because the distance between the sensing means 18 and position-correcting means 20, 16, 17 of the fine regulating loop is considerably less than the distance between the sensing means 21 and position-correcting means 5, 6 of the coarse regulating loop.

It will be understood that a very great variety of web edge position detectors, regulators, and position correctors are comprehended within the scope and spirit of the present invention.

It will be understood that each of the elements described above, or two or more together, may also find a useful application in other types of circuits and constructions differing from the types described above.

While the invention has been illustrated and described as embodied in a system for regulating the position of the lateral edge of a web of paper travelling toward a rotary printing machine and sheet severing apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an apparatus for transporting an elongated web along a predetermined path, a regulating system for automatically keeping the position of the lateral edge of the travelling web within preselected first and second tolerance ranges, the regulating system comprising, in combination, sensing means operative for sensing the position of the lateral edge of the travelling web; position-correcting means operative when activated for effecting corrective movement of the travelling web in a direction causing the lateral edge thereof to change position; and regulating means connected to the sensing means and to the position-correcting means and operative for causing the latter to effect corrective movements of the travelling web at a first speed when the sensed position of the web edge is outside the first tolerance range and at a different second speed when the sensed position of the web edge is outside the preselected second tolerance range, the first tolerance range being a narrower tolerance range and the second tolerance range being a wider tolerance range, the first speed being a lower speed and the second speed being a higher speed.

2. In an apparatus as defined in claim 1, the first tolerance range having limit values located within the second tolerance range.

3. In an apparatus for transporting an elongated web along a predetermined path, a regulating system for automatically keeping the position of the lateral edge of the travelling web within preselected first and second tolerance ranges, the regulating system comprising, in combination, sensing means operative for sensing the position of the lateral edge of the travelling web; position-correcting means operative when activated for effecting corrective movement of the travelling web in a direction causing the lateral edge thereof to change position; and regulating means connected to the sensing means and to the position-correcting means and operative for causing the latter to effect corrective movements of the travelling web at a first speed when the sensed position of the web edge is outside the first tolerance range and at a different second speed when the sensed position of the web edge is outside the preselected second tolerance range, wherein the sensing means comprises a first sensing unit operative for generating first signals indicating that the web edge position has left the first tolerance range and a second sensing unit discrete from the first sensing unit and operative for generating second signals indicating that the web edge position has left the second tolerance range.

4. In an apparatus as defined in claim 3, wherein the regulating means comprises a single regulator connected to both the first and second sensing units for receiving said first and second signals and operative for controlling the operation of the position-correcting means in dependence thereon.

5. In an apparatus as defined in claim 4, wherein the position-correcting means comprises a first position-correcting device operative for effecting web edge position corrections at the first speed and a second position-correcting device discrete from the first position-correcting device and operative for effecting web edge position corrections at the second speed, the single regulator of the regulating means comprising means for controlling the operation of both position-correcting devices in dependence upon the signals generated by the first and second sensing units.

6. In an apparatus as defined in claim 3, wherein the regulating means comprises a first regulator operative for causing the position-correcting means to effect corrective movements at the first speed and a second regulator discrete from the first regulator and operative for causing the position-correcting means to effect corrective movements at the second speed.

7. In an apparatus as defined in claim 3, wherein the position-correcting means comprises a first position-correcting device and a second position-correcting device discrete from the first position-correcting device, and wherein the regulating means comprises a first regulator connected to the first sensing unit and to the first position-correcting device and operative for causing the latter to effect corrective movements at the first speed in dependence upon the signals generated by the first sensing unit, and wherein the regulating means furthermore comprises a second regulator connected to the second sensing unit and to the second position-correcting device and operative for causing the latter to effect corrective movements at the second speed in dependence upon the signals generated by the second sensing unit.

8. In an apparatus as defined in claim 7, wherein the first regulator is an analog regulator and the second regulator is a non-analog regulator.

9. In an apparatus as defined in claim 8, wherein the first sensing unit is an analog sensing unit and the second sensing unit is a non-analog sensing unit.

10. In an apparatus as defined in claim 9, wherein the second regulator is an ON-OFF regulator.

11. In an apparatus as defined in claim 9, wherein the second regulator is a three-point regulator.

12. In an apparatus for transporting an elongated web along a predetermined path, a regulating system for automatically keeping the position of the lateral edge of the travelling web within preselected first and second tolerance ranges, the regulating system comprising, in combination, sensing means operative for sensing the position of the lateral edge of the travelling web; position-correcting means operative when activated for effecting corrective movement of the travelling web in a direction causing the lateral edge thereof to change position; and regulating means connected to the sensing means and to the position-correcting means and operative for causing the latter to effect corrective movements of the travelling web at a first speed when the sensed position of the web edge is outside the first tolerance range and at a different second speed when the sensed position of the web edge is outside the preselected second tolerance range, wherein the regulating means comprises a first regulator connected to both the sensing means and the position-correcting means and operative for causing the latter to effect corrective movement at the first speed when the sensed web edge position is outside the first range, wherein the regulating means furthermore comprises a second regulator discrete from the first regulator and connected to both the sensing means and the position-correcting means and operative for causing the latter to effect corrective movements at the second speed when the sensed web edge position is outside the second range.

13. In an apparatus as defined in claim 12, wherein the first regulator is an analog regulator and the second regulator is a non-analog regulator.

14. In an apparatus as defined in claim 13, wherein the non-analog second regulator is an ON-OFF regulator.

15. In an apparatus as defined in claim 13, wherein the non-analog second regulator is a three-point regulator.

16. In an apparatus for transporting an elongated web along a predetermined path, a regulating system for automatically keeping the position of the lateral edge of the travelling web within preselected first and second tolerance ranges, the regulating system comprising, in combination, sensing means operative for sensing the position of the lateral edge of the travelling web; position-correcting means operative when activated for effecting corrective movement of the travelling web in a direction causing the lateral edge thereof to change position; and regulatingmeans connected to the sensing means and to the position-correcting means and operative for causing the latter to effect corrective movements of the travelling web at a first speed when the sensed position of the web edge is outside the first tolerance range and at a different speed when the sensed position of the web edge is outside the preselected second tolerance range, wherein the sensing means comprises a single sensing device operative for generating a signal indicative of the position of the lateral edge of the travelling web, the regulating system including means for determining from such signal whether the edge position is outside one of the tolerance ranges.

17. In an apparatus for transporting an elongated web along a predetermined path, a regulating system for automatically keeping the position of the lateral edge of the travelling web within preselected first and second tolerance ranges, the regulating system comprising, in combination, sensing means operative for sensing the position of the lateral edge of the travelling web; position-correcting means operative when activated for effecting corrective movement of the travelling web in a direction causing the lateral edge thereof to change position; and regulating means connected to the sensing means and to the position-correcting means and operative for causing the latter to effect corrective movements of the travelling web at a first speed when the sensed position of the web edge is outside the first tolerance range and at a different second speed when the sensed position of the web edge is outside the preselected second tolerance range, wherein the sensing means comprises a single sensing device operative for generating a signal indicative of the position of the lateral edge of the travelling web, the regulating system including means for determining from such signal whether the edge position is outside one tolerance range and means for determining from such signal whether the edge position is outside both tolerance ranges.

* * * * *